US005662237A

United States Patent [19]

Cain

[11] Patent Number: 5,662,237

[45] Date of Patent: Sep. 2, 1997

[54] CONTAINER FOR TRANSPORT OR STORAGE OF FOOD ARTICLES

[76] Inventor: Deron M. Cain, 909 Norsan Court, Newmarket, Ontario, Canada, L3X 1L1

[21] Appl. No.: 697,284

[22] Filed: Aug. 27, 1996

[51] Int. Cl.[6] ..... B65D 1/34; B65D 43/03

[52] U.S. Cl. ..... 220/368; 426/127; 220/DIG. 6

[58] Field of Search ..... 220/367.1, 368, 220/551, 373, 374, DIG. 6; 426/124, 128, 127, 118; 99/DIG. 13; 206/545, 551

[56] References Cited

U.S. PATENT DOCUMENTS

| | | | |
|---|---|---|---|
| Re. 29,415 | 9/1977 | Ricobene et al. . | |
| 2,231,364 | 2/1941 | Mainzer . | |
| 2,561,488 | 7/1951 | Barker . | |
| 3,335,846 | 8/1967 | Mills . | |
| 3,442,433 | 5/1969 | Lombardi et al. . | |
| 3,809,064 | 5/1974 | Ziegler | 220/368 |
| 3,908,852 | 9/1975 | Ricobene et al. . | |
| 4,058,214 | 11/1977 | Mancuso . | |
| 4,201,301 | 5/1980 | Aggio . | |
| 4,237,171 | 12/1980 | Laage et al. . | |
| 4,344,534 | 8/1982 | Sutton . | |
| 4,360,118 | 11/1982 | Stern . | |
| 4,373,636 | 2/1983 | Hoffman . | |
| 4,441,626 | 4/1984 | Hall . | |
| 4,526,797 | 7/1985 | Stone, Jr. | 220/367.1 |
| 4,590,078 | 5/1986 | Umina | 220/367.1 |
| 4,666,057 | 5/1987 | Come et al. | 220/368 |
| 4,798,292 | 1/1989 | Hauze | 220/367.1 |
| 4,848,543 | 7/1989 | Doboze . | |
| 4,989,744 | 2/1991 | Tominaga | 220/367.1 |
| 5,076,434 | 12/1991 | Hoffman, Jr. . | |
| 5,180,075 | 1/1993 | Montalbano . | |
| 5,385,292 | 1/1995 | Labianca et al. . | |
| 5,423,477 | 6/1995 | Valdman et al. . | |
| 5,454,471 | 10/1995 | Norvell . | |
| 5,482,724 | 1/1996 | Morici et al. . | |

*Primary Examiner*—Joseph M. Moy
*Attorney, Agent, or Firm*—Riches, McKenzie & Herbert

[57] ABSTRACT

A container for storing or transporting heated food is constructed to keep water condensing from steam in the container from contacting the food item. The container includes a base Upon which the food item rests, and a cover portion which is adapted for placement-over the base to define a food storage chamber in which the food item is housed during storage and transport. Part of the cover portion is provided with a dual wall construction and has an inner wall portion positioned closest to the food storage food chamber and an outer wall portion spaced from the inner wall portion, so as to define a cavity therebetween. One or more openings are formed through the inner wall portion providing gaseous communication between the food storage chamber and the cavity. A series of ribs are provided about the openings to prevent condensate which forms in the cavity from returning through the openings into the chamber where it may otherwise contact the food.

20 Claims, 5 Drawing Sheets

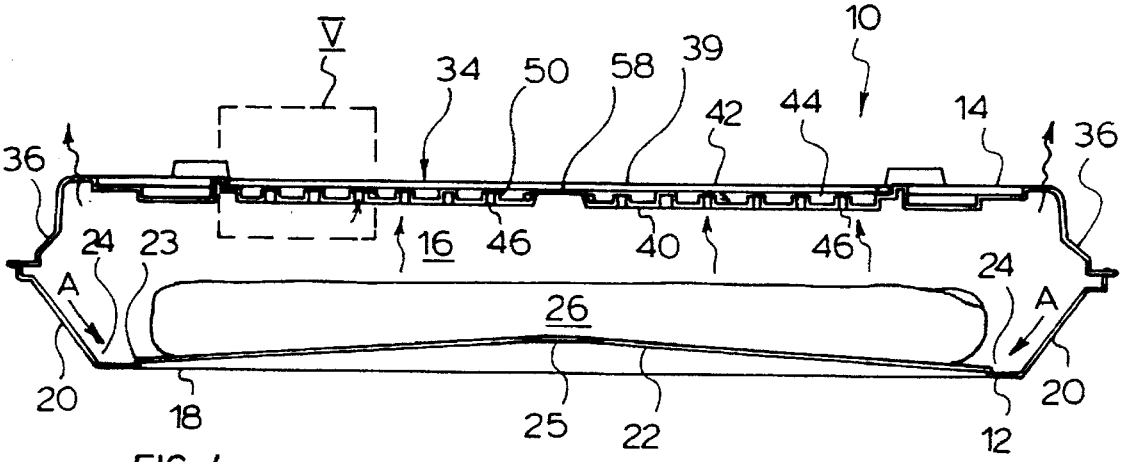
FIG. 4.
FIG. 5.
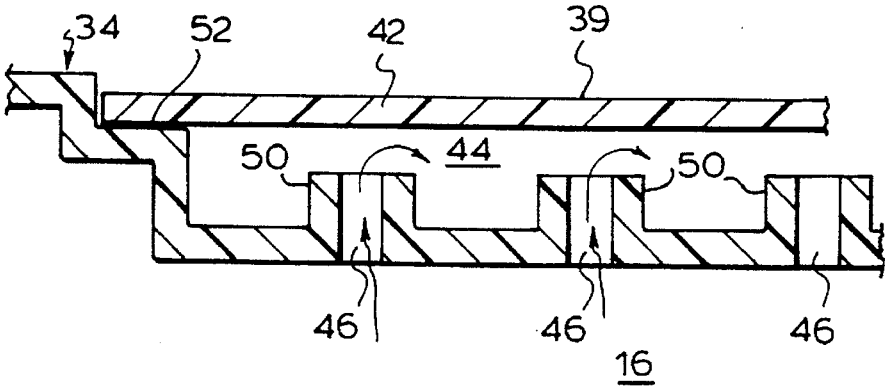

CONTAINER FOR TRANSPORT OR STORAGE OF FOOD ARTICLES

SUMMARY OF THE INVENTION

The present invention relates to a container for transporting or storing food such as pizza, and more particularly to a container which configured to store a hot food item while preventing condensation from being reabsorbed by the food, and which may be easily manufactured and recycled.

BACKGROUND OF THE INVENTION

Containers for storing and transporting heated food such as pizza, chicken wings and the like are well known. Conventional food storage containers and pizza boxes are designed to maintain the pizza (or other food items) in a warm state during delivery to the purchaser. A difficulty with the long term storage of hot pizza and other heated food products exists in that steam from the hot food tends to condense to water within the containers. The condensate water in turn drips back onto the pizza, where it may be re-absorbed, making the pizza soggy and otherwise adversely affecting food quality and taste.

Numerous attempts have been made to provide a pizza box which prevents condensation from the pizza from being reabsorbed. U.S. Pat. No. 5,423,477 to Valdman et al, issued Jun. 13, 1995, discloses a pizza box which incorporates a cover coated with a moisture absorbing inner layer of starch. U.S. Pat. No. 5,454,471 to Norvell, issued Oct. 3, 1995, discloses a food container for heated pizza which incorporates multi-layer sidewall construction which is manufactured so as to permit the selective release of water vapour.

A difficulty with prior art pizza boxes and food storage containers designed to keep moisture away from heated food exists in that they are both prohibitively expensive and difficult to manufacture. In addition, the specialized coatings and layered construction of such known pizza boxes do not readily permit the customization of the box, as for example by printing corporate logos, advertising or other indicia on the boxes. This has led to a reluctance by large pizza retail chains to adopt the boxes.

As well, because of the special coatings and layered construction used in conventional food storage containers which are designed to keep moisture from the food, the containers do not readily lend themselves to either recycling or re-use.

SUMMARY OF THE INVENTION

To at least partially overcome the disadvantages of the prior art devices, the present invention provides for a food container having a food storage chamber for maintaining heated food in a warmed state therein, and which is constructed to trap condensed moisture in a cavity separate from the food storage chamber.

Another object of the invention is to provide a food storage container which may be easily and inexpensively manufactured.

A further object of the invention is to provide a storage container for a heated food item, such as pizza, which may be easily recycled.

A further object of the invention is to provide a pizza box having a simplified construction, which preserves a heated pizza in a warm state without the use of a warming apparatus or the like.

Another object of the invention is to provide a storage container for a food item which maintains a warm food item in a substantially dry state without requiring the use of moisture absorbing inserts or coating.

A further object of the invention is to provide a storage container for the storage or delivery of a warmed food item which may be easily and inexpensively customized to include the corporate logo or advertising material of a particular retail outlet, without requiring specialized printing.

Another object of the invention is to provide a plastic pizza box which is adapted to secure a removable cardboard or paperboard panel which is printed with indicia on a conventional press or laser printer, or photocopier.

A further object of the invention is to provide a food storage container which may be used to store a food item both in a frozen state and while the food is heated in a microwave or radiant heat oven.

In one embodiment, the present invention resides in a container for storing or transporting a heated food item such as pizza, chicken wings, ribs or any other hot food purchased for take-out. The container is constructed to keep water which condenses from steam emanating from the food item from contacting the food item where it may otherwise be re-absorbed. The container comprises a base which includes a surface upon which the food item rests during transport, and a cover portion. The cover portion is adapted for releasable placement over the base to define a closed food storage chamber in which the food item is housed during storage and transportation.

Part of the cover portion is provided with a dual wall construction having an inner wall and an outer wall. When the cover portion is closed to form the food storage chamber, the inner wall is spaced towards the food storage food chamber and forms a side or .top wall of the food chamber. The outer wall is spaced from the inner wall portion outwardly from the food storage chamber by a distance sufficient to define a cavity between the inner and outer walls. One or more openings are provided through the inner wall to permit gaseous communication between the food storage chamber and the cavity. In this manner, the steam originating from a food item stored in the food storage chamber may pass into the cavity. Preferably, the cavity is configured to retain and trap any water or other condensed liquids therein, substantially preventing return of the water or condensed liquids into the food storage chamber. Trapping the condensate or condensed liquids in the cavity not only prevents the food item from contacting and reabsorbing the water, but also advantageously maintains the food item in a warmed state. The warm water or condensation which is trapped in the cavity radiates its heat back into the food storage chamber, and assists in keeping the food item warm.

The outer wall of the cover portion may be provided as a fixed part of the cover portion. For ease of manufacture, however, the outer wall is more preferably removable from a remainder of the cover portion as, for example, a removable panel. By providing the outer wall as a removable panel, the outer wall may be made from a number of different materials such as paper, plastic or foil laminated cardboard or paperboard. More preferably, the removable panel is made from conventional paperboard or cardboard. The conventional paperboard or cardboard may be printed with the local retail outlet's logo and the like on a conventional laser printer or photocopier, without requiring custom printing of the entire pizza box.

In forming the closed food storage container, the cover portion may directly engage a peripheral edge of the base. Alternately, the base may be provided as part of a lower tray portion which includes a peripheral sidewall which extends upwardly about the base, and wherein the cover portion releasably engages a portion of the sidewall. The cover portion may be either completely detachable from the base or lower tray portion, or may be hingely coupled thereto to close or open the food storage chamber as access is needed.

More preferably, the part of the cover portion which forms the condensation trapping cavity is provided in a top wall of the container which, when the cover portion closes the food storage chamber, substantially overlies the food item. The top wall may be provided with either one or more separate cavities, or a single cavity which is divided into sub-cavities, each communicating with the food storage chamber via one or more openings. To prevent condensation in the cavities or sub-cavities from moving back into the food storage chamber, a number of ribs may be provided which project upwardly about each of the openings. The ribs thus act to prevent water which condenses in the cavities or sub-cavities from flowing back through the openings and into the food storage chamber.

Accordingly, in one aspect the present invention resides in a container for transporting and storing a heated food article comprising, a base for supporting said heated food article, a peripheral wall extending generally upwardly about said base, and a cover portion releasably engaging a portion of said peripheral wall to form a food chamber sized to receive said heated food article therein, said cover portion including, a top wall having inner wall means which when said cover portion forms said food chamber is spaced towards said chamber, and an outer wall means spaced from said inner wall means so as to define a cavity therebetween, and aperture means extending through said inner wall means to provide gaseous communication between said chamber and said cavity while substantially preventing return flow of condensation from said cavity into said chamber, whereby steam from said chamber may move through said aperture means into said cavity.

In another aspect, the present invention resides in a pizza container for transporting and storing a heated pizza in a warmed state comprising, a base including a supporting surface for supporting said pizza, a peripheral wall extending generally upwardly about said base, and a cover portion releasably engaging a portion of said peripheral wall, to form a food chamber sized to receive said pizza therein, the improvement wherein, the cover portion includes a top wall having inner wall means which when said cover portion forms said food chamber is spaced towards said chamber and an outer wall means spaced from said inner wall means so as to define a cavity therebetween, said outer wall means being removably secured to a remainder of the cover portion, and at least one aperture extending through said inner wall means providing gaseous communication between said chamber and said cavity, whereby steam from said chamber may move through said at least one aperture into said cavity.

In a further aspect, the present invention resides in a container for storing a food article in a frozen or warm state, a base for supporting said food article, a peripheral wall extending upwardly substantially about said base, and a cover portion releasably movable to a closed position engaging said peripheral wall whereby said cover portion, said peripheral wall and said base define a food chamber sized to receive said food article therein, said cover portion including, a top wall having inner wall means and an outer wall means, whereby when said cover portion is closed, said inner wall means is spaced towards said chamber and said outer wall means spaced a distance from said inner wall means so as to define a cavity between said inner and outer wall means, and a plurality of apertures extending through said inner wall means to provide gaseous communication between said chamber and said cavity, whereby gases or steam from said chamber may move through said apertures into said cavity, and a plurality of rib means, each rib means provided about a corresponding one of said apertures and extending from said inner wall means part-way towards said outer wall means, wherein said rib means restrict condensation in said cavity from moving through said apertures into said chamber.

BRIEF DESCRIPTION OF THE DRAWINGS

Further objects and advantages of the invention will appear from the following description, together with the accompanying drawings in which:

FIG. 4 is a cross-section view of the pizza box of FIG. 1 taken along lines 4—4';

FIG. 5 is an enlarged view of the portion of the pizza box shown in FIG. 4 indicated by Roman numeral V.

DETAILED DESCRIPTION OF THE DRAWINGS

Figure 1:
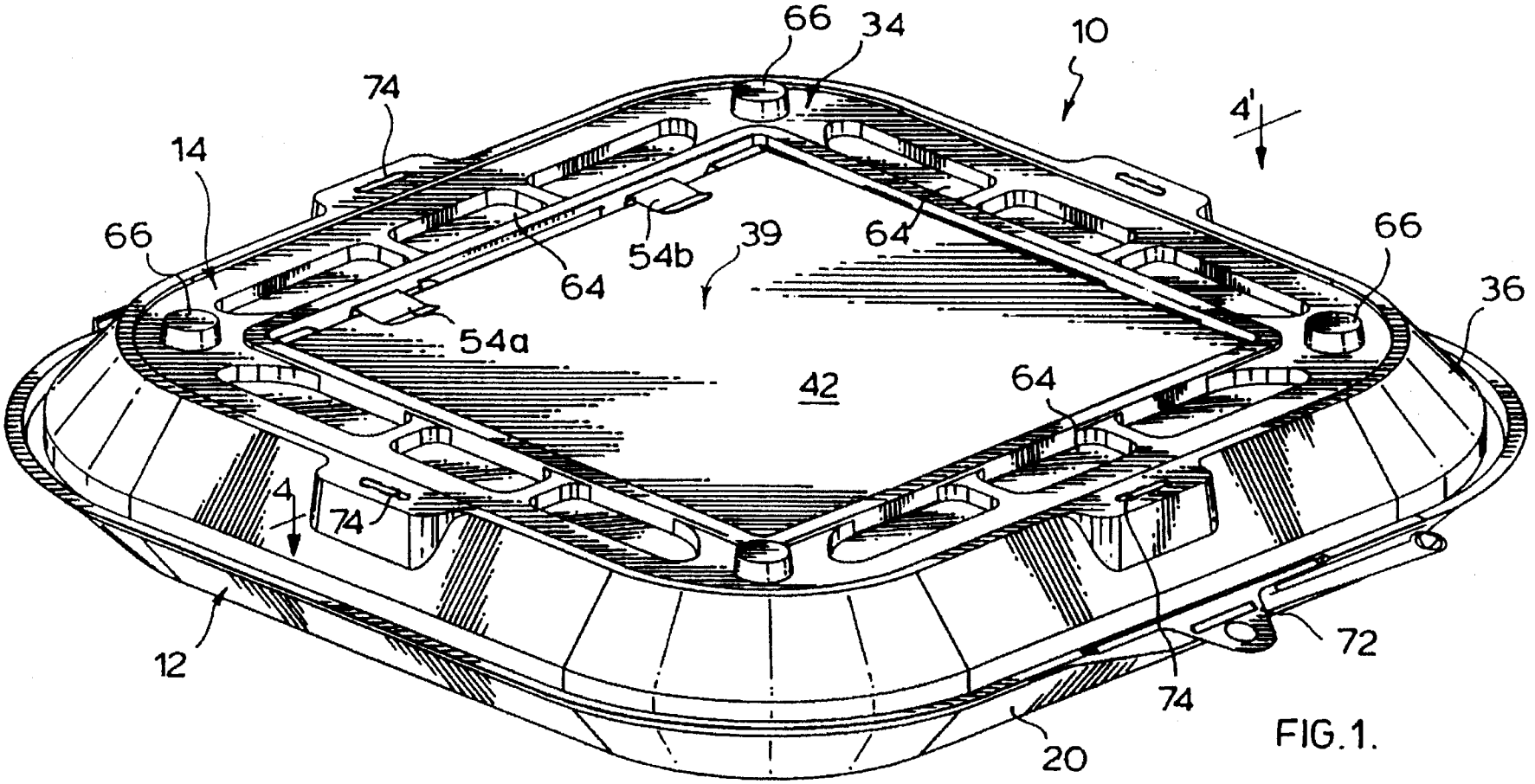
FIG. 1 is a perspective view of a closed pizza box in accordance with a preferred embodiment of the present invention, with a removable outer wall panel secured to the top wall of the box.

Reference is made to FIGS. 1 to 6 which show a pizza box generally indicated 10 which comprises a lower food tray portion 12 and an upper cover portion 14. As will be described, the tray portion 12 and cover portion 14 are formed to co-operate to form a closed chamber 16 (FIG. 4) for housing and insulating a hot pizza 26.

The cover portion 14 is adapted to releasably engage part of the food tray portion 12 so as to be movable between an open position (FIG. 6), permitting access to the interior of the food tray portion 12, and a closed position (FIG. 1) wherein the cover portion 14 engages the food tray portion 12 and closes the food chamber 16.

Figure 3:
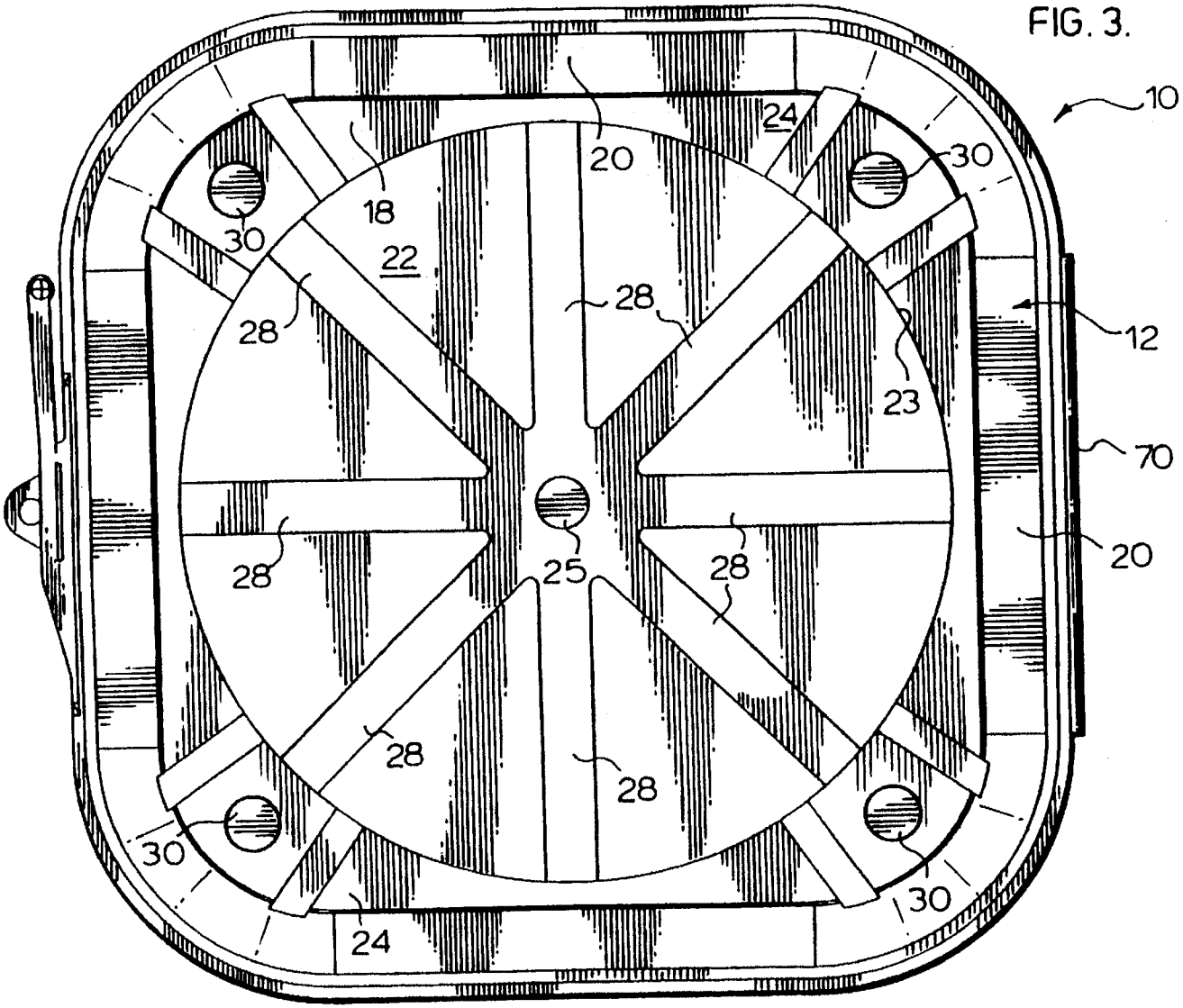
FIG. 3 is a perspective bottom view of the pizza box of FIG. 1.
Figure 6:
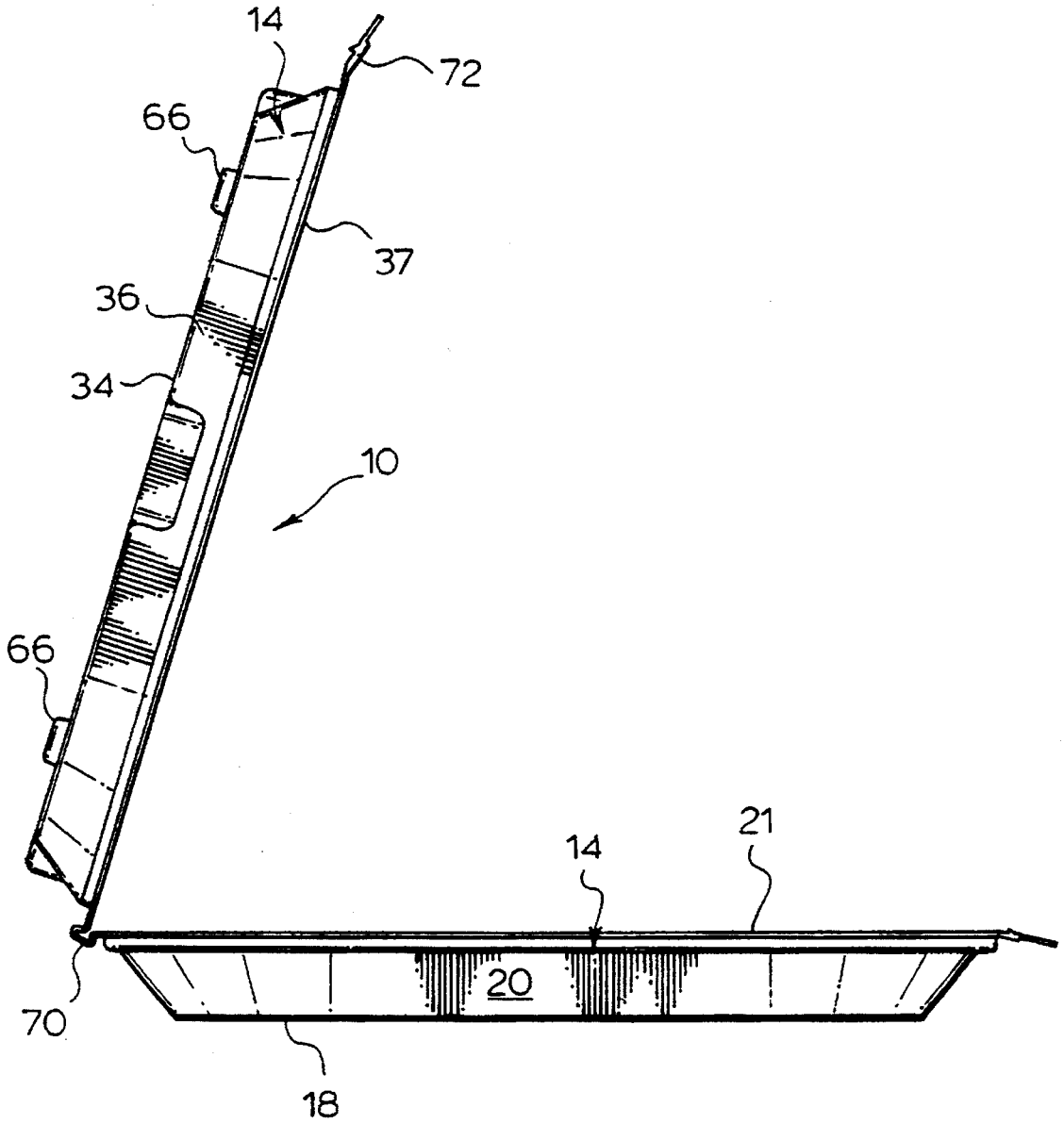
FIG. 6 is a perspective side view of the pizza box shown in FIG. 1 in an open configuration.

The food tray portion 12, shown best in FIGS. 3, 4 and 6, includes a generally square base 18 and a sidewall 20. The sidewall 20 extends upwardly about the peripheral edge of the base 18, angling outwardly from the base 18 to an uppermost sidewall edge 21 (FIG. 6).

FIGS. 3 and 4 show the base 18 as including a centrally positioned pizza supporting surface 22. The pizza supporting surface 22 is sized to underlie and support a pizza 26 (FIG. 4) thereon. As shown best in FIG. 4, the supporting surface 22 is formed having marginally upwardly domed or conical shape. The supporting surface 22 is further raised upwardly relative to a peripheral remainder of the base 18. In this manner, the pizza supporting surface 22, and therefore the pizza 26, slope upwardly and radially inwardly from the peripheral edge 23 of the surface 22 at an angle between about 3 and 15°, to an upwardly projecting center button 25 located in the center of the base 18. The result, therefore, is that the center of the base 18 is raised about 0.5 to 0.75 inches upwardly above its peripheral edge. By raising the center of the base 18, any moisture or condensation which forms on the pizza 26 is shed off of the pizza 26, moving downwardly towards the edges of the tray portion 12.

The peripheral portion of the base 18 which is bordered inwardly by the peripheral edge 23 of the raised pizza supporting surface 22 and outwardly by the sidewall 20, acts as an upwardly open moisture collecting trough 24, extending about the periphery of the supporting surface 22. The moisture collection trough 24 advantageously maintains any condensation which collects therein out of contact with the pizza 26, where it may otherwise be re-absorbed. Because the pizza 26 is supported on surface 22 which is spaced above the trough 24, the pizza 26 is maintained a spaced distance above any condensation which collects in the trough 24 during storage or transportation.

The sloping shape of the supporting surface 22 advantageously sheds condensation forming both under and on top of the pizza 26 into the collection channel 24. By shedding the condensation away from the pizza 26, there is no possibility that the pizza 26 may reabsorb any condensate.

In addition, the outwardly sloping shape of the sidewall 20 acts to redirect condensation in the direction of arrows A, into the trough 24.

The pizza supporting surface 22 is shown as also including a number of upwardly projecting elongated ribs 28. As shown best in FIG. 3, the ribs 28 are arranged to extend radially outwardly from the center button 25 of the supporting surface 22 and extend to the peripheral edge 23. The upward projection of the center button 25 and the radial positioning of the ribs 28 advantageously ensures that condensation will flow substantially unhindered by the pizza 26 downwardly along the surface 22. The button 25 and ribs 28 assist in permitting air flow between the remainder of the supporting surface 22 and pizza 26 and facilitate the drainage of any condensate which forms beneath the pizza 26 into the collection trough 24.

FIG. 3 shows best the base 18 as further including four upwardly extending cylindrical depressions 30. The cylindrical depressions 30 are each formed provided in the trough 24 portion of the base 18, spaced towards a respective corner of the pizza box 10. As will be described hereafter, the depressions 30 assist in maintaining a number of pizza boxes 10 in a configuration stacked one on top of another, to minimize storage space.

FIG. 1 shows best the cover portion 14 as including a generally flat square top wall 34 and a cover sidewall 36. The sidewall 36 extends about the periphery of the top wall 34, projecting downwardly at an outward angle to a lower edge 37 (FIG. 6).

FIG. 4 shows best the food tray portion 12 and cover portion 14 as having complementary profiles which permit the selective opening and closing of the pizza box 10. In this regard the top wall 34 has an overall size and shape generally corresponding to that of the base 18. Each of the sidewalls 20,36 extend at approximately the same angular distance outwardly from the base 18 and top wall 34, respectively, so that when closed, the lower edge 37 of the sidewall 36 is moved flush against the upper edge 21 of sidewall 20.

The cover portion 14 and tray portion 12 are constructed so that when the cover portion 14 is moved to the closed position, the top wall 34 assumes a substantially horizontal orientation directly overlying the base 18 of the pizza box 10. In this manner, when the cover portion 14 is closed, the lowermost extent of the chamber 16 is defined by the base 18, the sides of the chamber 16 are defined by sidewalls 20,36, and the upper surface of the chamber 16 is defined by the top wall 34.

FIGS. 1, 2, 4 and 5 show best the top wall 34 as including a generally square central area 39 which, when the cover portion 14 is closed, overlies the food supporting surface 22 and acts as a condensation trap. The central area 39 of the top wall 34 is constructed to prevent water which condenses from steam originating from the pizza 26 from forming on the upper surface of the chamber 16, where it may otherwise drip back onto the pizza 26. In this regard, the central area 39 is formed having a double wall construction. The central area 39 is provided with an inner wall panel 40 which borders the top of the food chamber 16, and an outer wall panel 42, which is spaced a distance outwardly from the inner wall 40 outwardly from the food chamber 16, so as to define a cavity 44 therebetween.

Figure 2:
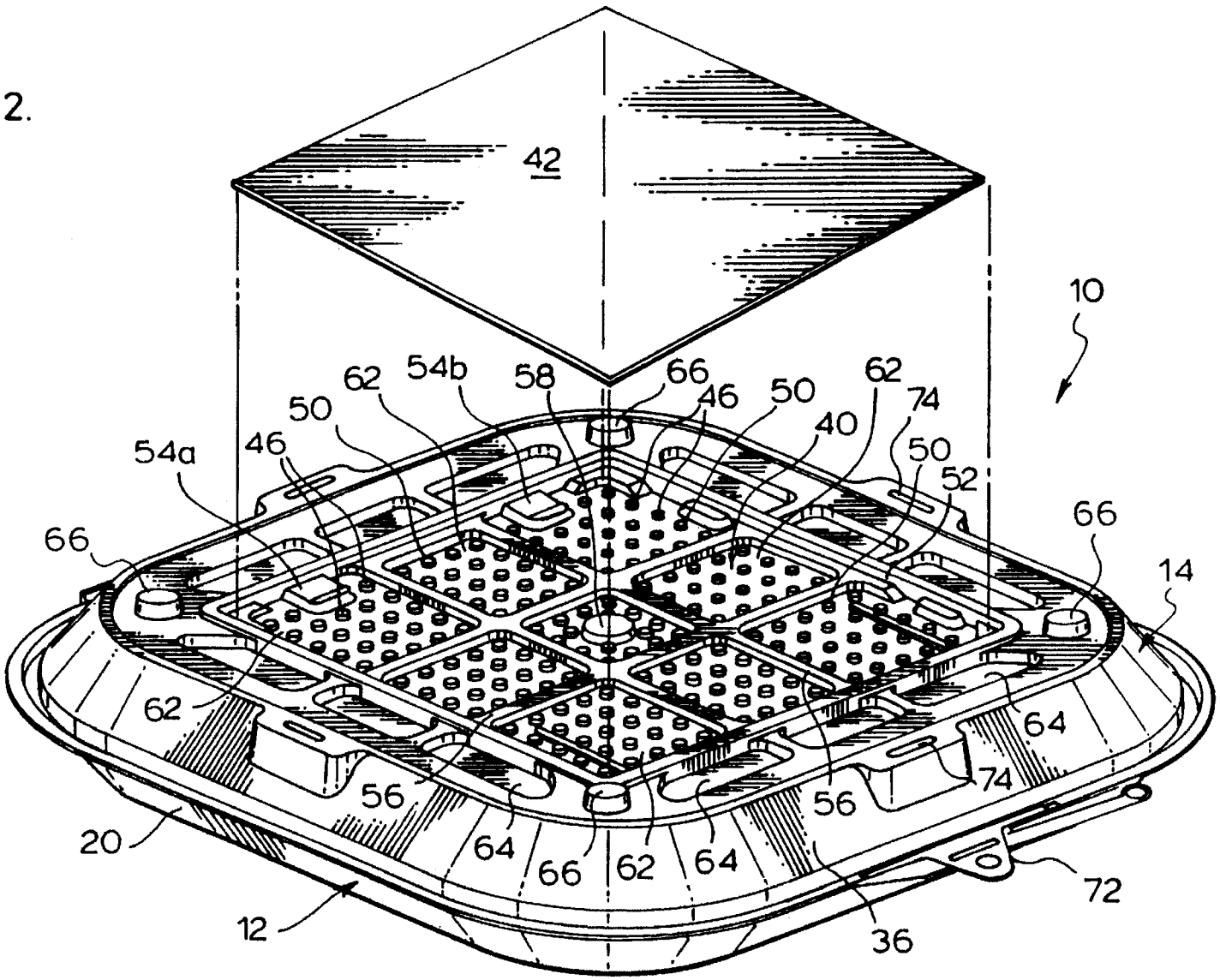
FIG. 2 is an exploded perspective view of the pizza box of FIG. 1, showing the attachment of the removable outer wall panel.

FIG. 2 shows best the top wall 34 as further including a number of circular openings 46 extending through the inner wall panel 40. The openings 46 provide gaseous communication between the food chamber 16 and cavity 44 when the cover portion 14 is closed. As such, the openings 46 permit steam from the food chamber 16 to move into the cavity 44. As shown best in FIGS. 2 and 5, a number of annular ribs 50 are provided on the inner wall panel 40, each extending about one of the openings 46. The ribs 50 project upwardly from the upper surface of the inner wall panel 40, into the cavity 44, a distance part-way towards the outer wall panel 42.

The upward projection of the ribs 50 advantageously acts to trap any water which condenses in the cavity 44 and falls onto the inner wall 40 from returning back through the openings 46. In this manner, the condensate water is kept from the food chamber 16 where it may otherwise contact and be re-absorbed by the pizza 26. By trapping the condensation in the cavity 44, the pizza 26 is advantageously maintained in a dry state within the food chamber 16. Trapping condensation within the cavity 44 provides the further advantage in that the warm steam and warm condensed water are kept within the box 10. The heat from steam and water trapped in the cavity 44 radiates back into the food chamber 16 and assist in keeping the pizza 26 warm.

FIGS. 1, 2 and 5 show best the outer wall panel 42 as comprising a removable square panel which may be detached from a remainder of the cover portion 14. When in place, the outer wall panel 42 is supported about its peripheral edges by a shoulder 52 (FIG. 5) which extends about the peripheral edge of the portion 39. The outer wall panel 42 is secured in place during transportation and storage of the pizza 26 by a pair of resilient clip members 54*a*,54*b*. The outer wall panel 42 is held in position by inserting a peripheral edge under the clip members 54*a*,54*b* in a friction fit.

A series of spacing webs 56 and spacer button 58 (FIG. 2) are additionally provided on the upper surface of the inner wall 40. The spacing webs 56 and spacer button 58 extend from the inner wall panel 40 to a position level with the shoulder 52. The webs 56 and button 58 engage the bottom surface of the outer wall panel 42 when the outer wall panel 42 is held in place by the clip members 54*a*,54*b*. The spacing webs 56 and button 58 advantageously ensure that the outer wall panel 42 is maintained the desired distance from the ends of the annular ribs 50, so as not to block with the flow of steam from the chamber 12 into the cavity 44.

In the embodiment shown, the spacing webs 56 advantageously divide the cavity 44 into nine separate smaller sub-cavities 62. Although not essential, the use of smaller separate sub-cavities 62 advantageously prevents condensate in the cavity 44 from pooling at a single location, where it might otherwise flow over the top edge of one or more of the annular ribs 50 and return to the chamber 16 through the openings 46.

Although not essential, FIGS. 1 and 2 show best the lid 34 as further including a number of reinforcing depressions 64. The depressions 64 extend about the periphery of the steam trapping central portion 39 and provide the cover portion 14 with increased structural integrity.

Four generally cylindrical projections 66 are each provided at one of the corners of the lid 34. The cylindrical projections 66 are sized and positioned for complementary placement within the cylindrical recesses 30 formed in the base portion 18 of a second pizza box 10. It is to be appreciated, that by inserting the top projections 66 of one box 10 into the bottom recesses 30 of another, a series of pizza boxes 10 may be vertically stacked together in a secure arrangement.

FIG. 6 shows best the cover portion 14 as being hingely coupled to the food tray portion 12 by a hinge 70. The hinge 70 joins an adjacent edge portion of the peripheral sidewall 20 and cover sidewall 36. In this manner, the cover portion 14 pivots about the hinge 70 between open and closed positions. A snap closure 72 is provided on a portion of sidewall 36 opposite to the hinge 70. The closure 72 engages a corresponding portion of the sidewall 20 in a complementary fit to secure the cover portion 14 in the closed position over the food tray portion 12.

Although not essential, the box 10 may be provided with one or more vents 74 (FIGS. 1 and 2) which pierce the cover portion 14 and provide for the release of steam from the chamber 16.

It is to be appreciated, that with the exception of the outer wall panel 42, the food tray portion 12 and the remainder of the cover portion 14 may be integrally formed from a single unitary piece of plastic, as for example, injection or press molding. One preferred plastic for use in the present invention is a polyethylene sold by Eastman Materials under the trade mark PET 9921W™. In addition to being thermally stable at temperatures up to 450° PET 9921W™ is both Gamma and ETO sterilizable making it ideal for use in containers used to store food. In particular, because the plastic may be sterilized, the food storage chamber 16 may be rendered bacteria and germ free prior to use or re-use of the box 10. The absence of bacteria and germs in the chamber 16 thereby permits longer storage of food without spoilage.

In manufacture, the food tray 12 and the remainder of the cover portion 14, other than the panel 42, may be formed having a thin sidewall construction of only about 0.0025 to 0.003 inches thick. The thin wall construction of the pizza box 10 not only minimizes the amount of plastic required in manufacture, but also facilitates recycling.

The outer panel wall 42 may also be made from a sheet of plastic, paper, or a plastic or paper laminate, however, more preferably the outer panel wall 42 comprises a sheet of cardboard or paperboard. By using cardboard or paperboard, the name of the pizza vendor or other advertising or indicia may be printed on the outer wall 42 by conventional laser printers or photocopiers. In addition, the pizza box 10 may be easily recycled or reused after washing simply by removing and/or replacing the outer wall panel 42.

In addition, because the wall panel 42 is removable, the box 10 may be used for the long term storage of a pizza 26 in a frozen state, as well as in heating the pizza. If the frozen pizza 26 is to be heated in a conventional oven, a box 10 containing a frozen pizza 26 may be taken directly from a freezer and the cover 46 removed. The box 10 (without the cover 46) may then be placed directly in a microwave or conventional oven and heated to a temperature of up to 450° F. If desired, following the heating of the pizza 26 to a warm state, the cover 46 can be re-attached by inserting its edge under the clip members 54*a*,54*b*, to keep the pizza hot.

While the preferred embodiment of the invention discloses the use of plastic to form the bulk of the food tray portion and cover portion, the invention is not so limited. If desired, paper or other laminates or materials are also possible and will now become apparent. The detailed description discloses PET 9921W™ as one plastic for use in the present invention. Those skilled in the art will, however, appreciate other preferred thermally stable plastics which withstand temperatures of 200° F. or more which may be used. Other suitable plastics would therefore include other polyethylenes, polypropylenes, and polystyrenes which most preferably incorporate a K-resin to reduce brittleness.

FIGS. 1 to 6 show the preferred positioning of the cavity 44 directly over the food supporting surface 22 as being in the optimal position to collect steam rising off of the pizza 26. Although less preferred, however, the cavity 44 could also be located in whole or in part in the sidewalls 20,36.

While the preferred embodiment of the invention is disclosed for use with pizza, it is to be appreciated that the present invention is equally applicable for use with almost any heated food item.

Although FIGS. 1 to 3 show the pizza box 10 as having a generally square shape, the invention is not so limited. If desired, the pizza box could be provided with a circular, triangular or other polygonal shaped construction, depending on the food item to be stored.

FIGS. 2 and 5 show the cover portion 14 as including a number of circular openings 46 and annular ribs 50, however, other shaped openings and rib members are also possible and will now become apparent.

Although the disclosure describes and illustrates a preferred embodiment of the invention, it is to be understood that the invention is not limited to this particular embodiment. Many variations and modifications will now occur to those skilled in the art. For a definition of the invention, reference is made to the appended claims.

I claim:

1. A container for transporting and storing a heated food article comprising, a base for supporting said heated food article, a peripheral wall extending generally upwardly about said base, and a cover portion releasably engaging a portion of said peripheral wall to form a food chamber sized to receive said heated food article therein, said cover portion including, a top wall having inner wall means which when said cover portion forms said food chamber is spaced towards said chamber, and an outer wall means spaced from said inner wall means so as to define a cavity therebetween, and aperture means extending through said inner wall means to provide gaseous communication between said chamber and said cavity while substantially preventing return flow of condensation from said cavity into said chamber, whereby steam from said chamber may move through said aperture means into said cavity.

2. A container as claimed in claim 1, wherein said outer wall means is removably secured to a remainder of the cover portion.

3. A container as claimed in claim 2, wherein said outer wall means comprises a panel selected from the group consisting of cardboard, paperboard and plastic, and said cover portion further includes retention means for releasably securing said panel to said remainder of the cover portion.

4. A container as claimed in claim 1, wherein said aperture means comprises a plurality of apertures extending through said inner wall means, and a plurality of concentric rib means, each rib means disposed about a corresponding one of said apertures and extending towards said outer wall means.

5. A container as claimed in claim 2, wherein said aperture means comprises a plurality of apertures extending through said inner wall means, and a plurality of concentric rib means, each rib means disposed about a corresponding one of said apertures and extending towards said outer wall means.

6. A container as claimed in claim 5, wherein said base includes a food supporting surface and peripheral channel means, said channel means provided substantially about said food supporting surface and extending downwardly relative to said supporting surface.

7. A container as claimed in claim 1, wherein said base includes a food supporting surface and peripheral channel means, said channel means provided substantially about said food supporting surface and extending downwardly relative to said supporting surface.

8. A container as claimed in claim 7, wherein said food supporting surface comprises a conical surface which slopes upwardly and radially inwardly from channel means.

9. A container as claimed in claim 2, wherein said food article comprises pizza, and said base, said peripheral wall and said remainder of said cover portion comprise plastic.

10. A container as claimed in claim 7, wherein said cover portion includes a plurality of chambers, said plurality of chambers being disposed substantially above said food supporting surface when said cover portion engages said portion of said peripheral wall.

11. A container as claimed in claim 6, wherein said cover portion further includes spacing means for maintaining said outer wall means spaced a distance from said inner wall means and said rib means.

12. A container as claimed in claim 4, wherein said cover portion further includes spacing means for maintaining said outer wall means spaced from said inner wall means and said rib means.

13. A container as claimed in claim 1, wherein said cover portion further includes a cover sidewall portion extending downwardly about said top wall, wherein a lowermost edge of said cover sidewall portion engaging an upper edge of said peripheral wall to close said food chamber.

14. A container as claimed in claim 1, wherein said cover portion is hingely connected to said peripheral wall by an integrally formed hinge.

15. A pizza container for transporting and storing a heated pizza in a warmed state comprising, a base including a supporting surface for supporting said pizza, a peripheral wall extending generally upwardly about said base, and a cover portion releasably engaging a portion of said peripheral wall, to form a food chamber sized to receive said pizza therein, the improvement wherein, the cover portion includes a top wall having inner wall means which when said cover portion forms said food chamber is spaced towards said chamber and an outer wall means spaced from said inner wall means so as to define a cavity therebetween, said outer wall means being removably secured to a remainder of the cover portion, and at least one aperture extending through said inner wall means providing gaseous communication between said chamber and said cavity, whereby steam from said chamber may move through said at least one aperture into said cavity.

16. A container as claimed in claim 15 wherein said cover portion further includes annular flange means disposed about each of said apertures, said flange means extending from said inner wall means part-way towards said outer wall means to substantially prevent said cavity from moving through said openings into said food chamber.

17. A container as claimed in claim 15, wherein said supporting surface comprises a generally conical surface disposed towards a central portion of said base, said supporting surface sloping upwardly and radially inwardly towards said central portion.

18. A container for storing a food article in a frozen or warm state, a base for supporting said food article, a peripheral wall extending upwardly substantially about said base, and a cover portion releasably movable to a closed position engaging said peripheral wall whereby said cover portion, said peripheral wall and said base define a food chamber sized to receive said food article therein, said cover portion including, a top wall having inner wall means and an outer wall means, whereby when said cover portion is closed, said inner wall means is spaced towards said chamber and said outer wall means spaced a distance from said inner wall means so as to define a cavity between said inner and outer wall means, and a plurality of apertures extending through said inner wall means to provide gaseous communication between said chamber and said cavity, whereby gases from said chamber may move through said apertures into said cavity, and a plurality of rib means, each rib means provided about a corresponding one of said apertures and extending from said inner wall means part-way towards said outer wall means, wherein said rib means restrict condensation in said cavity from moving through said apertures into said chamber.

19. A container as claimed in claim 18, wherein said base includes a food supporting surface and peripheral channel means extending substantially about said food supporting surface, the channel means located adjacent said peripheral wall, and extending downwardly below said food supporting surface.

20. A container as claimed in claim 18, wherein said outer wall means is removably secured to a remainder of the cover means, the cover means further including spacing means for maintaining said outer wall means spaced from said inner wall means and said rib means.

* * * * *